United States Patent [19]

Thelen et al.

[11] 4,129,004

[45] Dec. 12, 1978

[54] METHOD AND APPARATUS FOR THE STORAGE OF ENERGY IN POWER PLANTS

[75] Inventors: Franz Thelen; Henning Weber, both of Mülheim, Fed. Rep. of Germany

[73] Assignee: Deutsche Babcock Aktiengesellschaft, Oberhausen, Fed. Rep. of Germany

[21] Appl. No.: 765,803

[22] Filed: Feb. 4, 1977

[30] Foreign Application Priority Data

Mar. 9, 1976 [DE] Fed. Rep. of Germany ..... 2609622

[51] Int. Cl.[2] ..... F01K 3/12; F01K 7/34

[52] U.S. Cl. ..... 60/652; 60/659; 60/679

[58] Field of Search ..... 60/652, 659, 679; 122/35

[56] References Cited

U.S. PATENT DOCUMENTS

| | | | |
|---|---|---|---|
| 2,942,411 | 6/1960 | Hutchings | 60/659 X |
| 3,448,580 | 6/1969 | Nettel | 60/652 |
| 3,448,581 | 6/1969 | Nettel | 60/652 |

FOREIGN PATENT DOCUMENTS

| | | | |
|---|---|---|---|
| 818361 | 7/1949 | Fed. Rep. of Germany | 60/678 |
| 381924 | 10/1932 | United Kingdom | 60/678 |

*Primary Examiner*—Allen M. Ostrager
*Attorney, Agent, or Firm*—Max Fogiel

[57] ABSTRACT

An arrangement for the storage of energy in power plants to cover peak-load conditions. Hot water is heated in the feed water preheaters and is stored in a hot water storage tank. The tank is filled and emptied alternately, with a tank receiving cold water. The stored hot water is kept at feed water temperature, so that the temperature is uniform throughout the storage tank level. During peak load, the hot water is fed directly into the feed water line behind the high-pressure water preheaters. A steam cushion is maintained above the water surface in the hot-water storage tank to provide pressure and volume balance. The hot-water line leading to the hot-water storage tank, discharges into the feed water line behind the pressure feed water preheaters. A high-pressure feed pump is located behind this junction, and the hot-water storage tank is located underground in a cavern. The steam cushion and the hot-water storage tank may be connected to one of the bleeder lines of the turbine.

6 Claims, 1 Drawing Figure

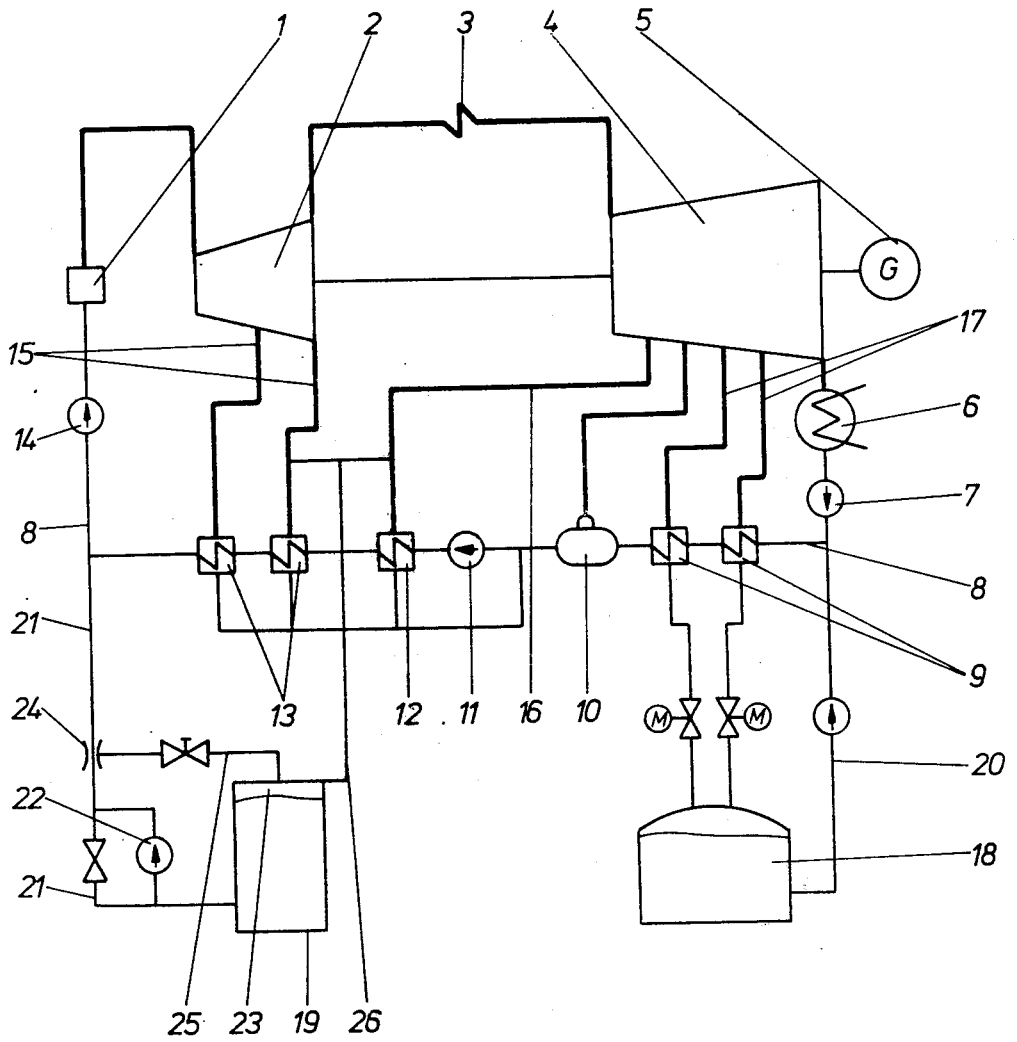
1
2
3
4
5
G
17
15
6
14
7
8
8
21
9
24
13
12
11
16
10
M
M
20
22
18
21
25
23
19
26

METHOD AND APPARATUS FOR THE STORAGE OF ENERGY IN POWER PLANTS

BACKGROUND OF THE INVENTION

The present invention relates to an arrangement for the storage of energy in power plants for peak-load coverage where hot water is heated in the feed water preheaters and is stored in a hot water storage tank which is filled and emptied alternately with a tank receiving cold water.

With a known conventional arrangement of this type, the storage is carried out as follows: Feed water is taken from a feed water tank and is delivered via a separate feed water pump through the feed water preheaters and is supplied via a charging valve to the hot-water storage tank which is constructed as a mixing preheater. At the same time, enough water is taken from the cold-water tanks that the water level in the feed water tank remains at the same level. To withdraw from storage, the hot water is delivered as boiling water, at a temperature corresponding to feed water temperature, under stepwise heat emission and expansion in the various feed water preheat stages, and is delivered back to the feed water tank and from there, together with the remaining feed water, to the feed water preheater. The storage reserve of such a storage system is about 10 minutes and is used where the furnace is sluggish and the storage capacity of the steam generator is low and greater load jumps are required.

Also it is known how to store hot water in a subterraneous cavern and to withdraw it during peak-load periods. The hot water storage is shunt-connected to the high-pressure feed water preheaters. The hot water is fed into the storage tank on top, and the cold water is withdrawn at the bottom. During the partial-load period, the cold water is passed through the high-pressure feed water preheaters, together with the feed water delivered to the steam generator. During the peak-load period, the withdrawal openings for the high-pressure preheaters are closed and the boiler is fed directly from the storage tank. Depending on the load condition, the separating surface between hot and cold water shifts in the hot-water storage tank. Hence the tank wall is subject to continuously changing expansions.

It is, therefore, an object of the present invention to simplify the storage of hot water and to keep the number of steam withdrawals to be used for peak-load periods as large as possible.

Another object of the present invention is to provide an arrangement of the foregoing character which is simple in construction and may be economically fabricated.

A further object of the present invention is to provide an arrangement, as described, which may be readily maintained in service and has a substantially longer operating life.

SUMMARY OF THE INVENTION

The objects of the present invention are achieved by providing that the stored hot water is kept at feed water temperature with a temperature uniform throughout the storage tank level; during peak-load, it is fed directly into the feed water line behind the high-pressure feed water preheaters. The cold water is temporarily stored in a separate tank. Since this water must not be thermally degassed, during peak load the steam withdrawals both to the high-pressure preheaters and to the low-pressure preheaters can be blocked and this steam can be used to increase power output. Since the temperature of the hot water stored in the hot water storage tank is essentially the same throughout the same level of the storage tank, the tank wall also assumes a fairly constant temperature. Hence it is subject to only small thermal stresses.

Hence the advantages claimed for such storage systems in terms of peak-load increase can be utilized in a simple manner. One of the essential advantages is that a separate peak-load power plant is not necessary as long as the turbo set, the feed water preheater and the storage tank are laid out in accordance with the maximum load conditions.

In one embodiment of the present invention, a steam cushion is maintained above the water surface to provide pressure and volume balance (compensation) in the hot water storage tank. This steam cushion can be formed at the expense of a certain pressure drop by evaporating the stored hot water or by withdrawn steam.

The hot water storage tank may be located underground in a cavern at a depth of about 500 m, while the cold-water storage tank is preferably mounted above ground.

During storage, the volume of the steam cushion must be reduced. This can be achieved by an additional embodiment of the present invention as follows. An injector which is connected to the steam cushion in the hot water storage tank is located in the hot water line leading to the hot water storage tank. The incoming water absorbs steam and condenses it. It is also possible that the steam cushion in the hot water storage tank is connected, via a balancing line, to one of the bleeder lines of the turbine. The steam can escape via this line. Inversely, when withdrawing from storage, the hot water can be pushed via this line by means of bleeder steam.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

BRIEF DESCRIPTION OF THE DRAWING

FIG. 1 shows the layout of the arrangement in accordance with the present invention.

DESCRIPTION OF THE PREFERRED EMBODIMENT

The steam generator 1 may be a fossil-fuel fired boiler or a nuclear reactor. The generated steam is expanded in a high-pressure turbine 2 and after a reheater 3, in a medium-pressure or low-pressure turbine 4. The turbines 2 and 4, mounted on one shaft drive a generator 5.

The turbine bleeder steam is precipitated in condenser 6 and delivered by a condensate pump 7 through the feed water line 8 to the low-pressure feed water preheater 9 and then to a feed water tank 10 which is provided with a degasser. A low-pressure pump 11 pushes the feed water through the high-pressure feed water preheaters 12 and 13. The preheated feed water is fed by a high-pressure feed pump 14 into the steam generator 1.

Bleeder lines 15 lead from the high-pressure turbine 2 to the high-pressure preheaters 13. Another bleeder line 16 connects the high-pressure preheater 12 to the medium pressure section of turbine 4. Finally, the low pressure feed-water preheaters 9 are supplied by the bleeder lines 17 with bleeder steam of the low-pressure section of the turbine.

For storing hot water, there is a cold-water storage tank 18 and a hot-water storage tank 19 which have about the same volume and are alternately filled and emptied. The cold-water storage tank 18 receives water from the condensate pump 7 via the cold-water line 20. The cold-water storage tank 18 is emptied in the opposite direction through the cold-water line 20 into the feed water line 8.

In the hot-water storage tank, the water is kept at uniform temperature throughout the level of the storage tank. The temperature of the hot water corresponds to that of the feed water behind the high-pressure preheater.

The hot-water storage tank is supplied with hot water from the feed water line 8 through the hot water line 21 at the pressure furnished by the low-pressure feed pump 11. When emptying the storage tank, the hot water is drawn by the high-pressure feed pump 14 through the hot-water line 21.

If the hot-water storage tank 19 is located underground in a cavern, the internal pressure of the hot water storage tank 19 can be absorbed by the bedrock. The wall of the storage tank 19 can either make direct contact with the bedrock or one provides an interstice between tank wall and bedrock. This space contains water or gas under pressure. The depth of the hot-water storage tank 19 underneath the earth's surface is chosen such that the earth pressure prevailing there equals the pressure of the hot water. For this arrangement, there is provided a backing pump 22 which draws hot water from the storage tank and delivers it to the high-pressure feed pump 14.

The hot water storage tank 19 has a steam cushion 23 above the water level. This steam cushion 23 which can be formed from the hot water at a certain pressure drop is used for balancing pressure and volume.

In order to avoid a pressure increase in the steam cushion 23 during the storing, the injector 24, which is located in hot water line 21, can draw steam from the steam cushion via a line 25 and condense it. The steam cushion 23 may also be connected via a separate balancing line 26 to a bleeder line 15 or 16 which is under a suitable pressure. Steam can escape from the steam cushion 23 via this balance line 26 which can be shut off.

During the low-load period, more water passes through the feed water line 8 than is taken up by the steam generator 1, with water being withdrawn from the cold-water storage tank 18. The excess water, which is heated in the feed water preheaters 9, 12 and 13 to feed water temperature, is stored in the hot water storage tank 19. During the peak-load period only hot water is withdrawn from the hot water storage tank 19, bypassing the feed water preheaters. The condensate produced in condenser 6 is temporarily stored in cold-water storage tank 18. The bleeder lines 15, 16 and 17 are closed during that time.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention, and therefore, such adaptations should and are intended to be comprehended within the meaning and range of equivalence of the following claims.

What is claimed is:

1. A method for the storage of energy in power plants with a boiler for peak-load coverage comprising the steps of: heating hot water in feed water preheaters; storing the heated water in a hot water storage tank; filling and emptying alternately said storage tank and a tank receiving cold water; holding the stored hot water at feed water temperature and maintaining the temperature uniform throughout the storage tank level; feeding the hot water during peak load directly into a feed water line downstream of the high-pressure water heater preheaters; said hot water storage tank and said tank receiving cold water having substantially the same volume; blocking bleeder lines leading to feed water heaters and supplying said boiler exclusively with hot water from said hot water storage tank during peak-load operation.

2. The method as defined in claim 1 including the step of maintaining a steam cushion volume above the water surface in the hot-water storage tank for providing pressure and volume balance.

3. Apparatus for storing energy in power plants with boiler means for peak-load coverage, comprising a hot-water storage tank; a hot-water line leading to said hot-water storage tank; high-pressure feed water preheaters; a feed water line behind said high-pressure feed water preheaters, said hot-water storage tank discharging into said feed water line; a high-pressure feed pump located behind the discharge of said hot-water storage tank into said feed water line; a cold water storage tank and said hot water storage tank being filled and emptied alternately; said hot water storage tank and said cold water storage tank having substantially the same volume; bleeder lines leading to feed water heaters being blocked during peak-load operation, said boiler means being supplied exclusively with hot water from said hot water storage tank during peak-load operation.

4. Apparatus as defined in claim 3 wherein said hot-water storage tank is located in an underground cavern.

5. Apparatus as defined in claim 3 including a turbine and bleeder lines; a steam cushion volume above the water surface in the hot-water storage tank for providing pressure and volume balance; said steam cushion volume being connected to one of said bleeder lines.

6. Apparatus for storing energy in power plants for peak-load coverage, comprising a hot-water storage tank; a hot-water line leading to said hot-water storage tank; high-pressure feed water preheaters; a feed water line behind said high-pressure feed water preheaters, said hot-water storage tank discharging into said feed water line; a high-pressure feed pump located behind the discharge of said hot-water storage tank into said feed water line injector means; a steam cushion volume above the water surface in the hot-water storage tank for providing pressure and volume balance; said injector means being connected to said steam cushion, said hot-water storage tank being located above-ground; said injector means being in said hot water line leading to said hot-water storage tank.

* * * * *